US009870840B2

(12) United States Patent
Park et al.

(10) Patent No.: US 9,870,840 B2
(45) Date of Patent: Jan. 16, 2018

(54) METALLIC GLASS, CONDUCTIVE PASTE, AND ELECTRONIC DEVICE

(71) Applicant: Samsung Electronics Co., Ltd., Suwon-Si, Gyeonggi-Do (KR)

(72) Inventors: Jin Man Park, Seoul (KR); Keum Hwan Park, Seoul (KR); Eun Sung Lee, Hwaseong-si (KR); Suk Jun Kim, Suwon-si (KR); Se Yun Kim, Seoul (KR); Sang Soo Jee, Hwaseong-si (KR); Do-hyang Kim, Seoul (KR)

(73) Assignees: Samsung Electronics Co., Ltd., Gyeonggi-do (KR); Yonsi University, University-Industry Foundation (UIF), Seoul (KR)

( * ) Notice: Subject to any disclaimer, the term of this patent is extended or adjusted under 35 U.S.C. 154(b) by 236 days.

(21) Appl. No.: 14/146,394

(22) Filed: Jan. 2, 2014

(65) Prior Publication Data

US 2014/0312283 A1 Oct. 23, 2014

(30) Foreign Application Priority Data

Apr. 23, 2013 (KR) ..... 10-2013-0045060

(51) Int. Cl.
*H01B 1/00* (2006.01)
*H01B 1/02* (2006.01)

(52) U.S. Cl.
CPC ..... *H01B 1/023* (2013.01)

(58) Field of Classification Search
CPC ..... H01B 1/023
USPC ..... 252/512
See application file for complete search history.

(56) References Cited

U.S. PATENT DOCUMENTS 9,314,879 B2 * 4/2016 Kubo ..... B23K 35/025
2005/0123686 A1 * 6/2005 Myrick ..... C23C 4/06 427/446
2008/0251164 A1 * 10/2008 Lohwongwatana .... C22C 45/00 148/528

(Continued)

FOREIGN PATENT DOCUMENTS

KR 20130052527 A 5/2013

OTHER PUBLICATIONS

Zhuo et al, Chin. Phys. Letters, vol. 26, No. 6, 2009, p. 066402.*

(Continued)

*Primary Examiner* — William Young
(74) *Attorney, Agent, or Firm* — Harness, Dickey & Pierce, P.L.C.

(57) ABSTRACT

According to example embodiments, a metallic glass includes aluminum (Al), a first element group, and a second element group. The first element group includes at least one of a transition metal and a rare earth element. The second element group includes at least one of an alkaline metal, an alkaline-earth metal, a semi-metal, and a non-metal. The second element group and aluminum have an electronegativity difference of greater than or equal to about 0.25. The second element group is included less than or equal to about 3 at % of the metallic glass, based on the total amount of the aluminum (Al), the first element group, and the second element group. A conductive paste and/or an electrode of an electronic device may be formed using the metallic glass.

13 Claims, 11 Drawing Sheets

(56) References Cited

U.S. PATENT DOCUMENTS

2009/0246070 A1* 10/2009 Tokuda ..... C22C 1/002
420/407
2013/0118572 A1 5/2013 Kim et al.

OTHER PUBLICATIONS

F.Q. Guo, S.J. Enouf, S.J. Poon, and G.J. Shiflet "Formation of ductile Al-based metallic glasses without rare-earth elements," Philosophical Magazine Letters: vol. 81, No. 3, (2001) (Abstract only).

* cited by examiner

METALLIC GLASS, CONDUCTIVE PASTE, AND ELECTRONIC DEVICE

CROSS-REFERENCE TO RELATED APPLICATION

This application claims priority under 35 U.S.C. §119 to Korean Patent Application No. 10-2013-0045060 filed in the Korean Intellectual Property Office on Apr. 23, 2013, the entire contents of which are incorporated herein by reference.

BACKGROUND

1. Field

Example embodiments relate to a metallic glass, a conductive paste, and/or an electronic device.

2. Description of Related Art

A metallic glass is an alloy having a disordered atomic structure including two or more elements. Metallic glasses may have a supercooled liquid region (ΔTx) between a glass transition temperature (Tg) and a crystalline temperature (Tx), and may be superplastically deformed to have a viscos flow.

When the metallic glass is plastically deformed in the supercooled liquid region, it may be easier to deform than a general metal so processing may be easier, and the wettability to a lower layer may increase. Thereby, the close contacting property to the lower layer may be enhanced.

Research on using the metallic glass as an electrode for an electronic device has been undertaken. The metallic glass may have conductivity, may be plastically deformed in the aforementioned supercooled liquid region as aforementioned, and may closely contact a lower layer such as a silicon wafer, and thus a metallic glass may be usefully applied as an electrode for an electronic device.

The conductivity and close contacting property of an electrode with a lower layer may be enhanced by increasing wettability of the metallic glass in the supercooled liquid region. The wettability of the metallic glass may be related to the size of the metallic glass powder. In other words, as the metallic glass powder has a smaller size, contact area and reactivity and thus wettability of the metallic glass may be enhanced.

However, a metallic glass may have higher ductility when it has a smaller size. Accordingly, it may be difficult to pulverize some metallic glasses into fine powder.

SUMMARY

Example embodiments relate to a metallic glass capable of increasing brittleness and being more minutely pulverized but still maintaining the metallic glass characteristic.

Example embodiments also relate to a conductive paste including metallic glass.

Example embodiments also relate to an electronic device including an electrode formed using a conductive paste including metallic glass.

According to example embodiments, a metallic glass includes: aluminum (Al), a first element group including at least one of a transition metal and a rare earth element; and a second element group including at least one of an alkaline metal, an alkaline-earth metal, a semi-metal, and a non-metal. The second element group has an electronegativity difference from the aluminum of greater than or equal to about 0.25. The second element group is included in an amount of less than or equal to about 3 at % based on a total amount of the aluminum (Al), the first element group, and the second element group.

In example embodiments, the metallic glass may be represented by the following Chemical Formula 1.

$$Al_aTM_bRE_cX_d \quad \text{[Chemical Formula 1]}$$

In the above Chemical Formula 1,

Al is aluminum,

TM is at least one kind of a transition metal,

RE is at least one kind of a rare earth element,

X is the second element group, $50<a\leq 99$, $0\leq b\leq 30$, $0\leq c\leq 30$, $0<d\leq 3$, at least one of b and c is not 0, and $a+b+c+d=100$.

In example embodiments, the second element group may include at least one of lithium (Li), sodium (Na), potassium (K), rubidium (Rb), cesium (Cs), magnesium (Mg), calcium (Ca), strontium (Sr), barium (Ba), boron (B), carbon (C), silicon (Si), germanium (Ge), nitrogen (N), phosphorus (P), arsenic (As), and antimony (Sb).

In example embodiments, the transition metal may include at least one of nickel (Ni), cobalt (Co), manganese (Mn), zirconium (Zr), titanium (Ti), vanadium (V), chromium (Cr), manganese (Mn), iron (Fe), copper (Cu), zinc (Zn), niobium (Nb), molybdenum (Mo), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), and gold (Au).

In example embodiments, the rare earth element may include at least one of scandium (Sc), yttrium (Y), lanthanum (La), cerium (Ce), praseodymium (Pr), neodymium (Nd), promethium (Pm), samarium (Sm), europium (Eu), gadolinium (Gd), dysprosium (Dy), holmium (Ho), erbium (Er), thulium (Tm), ytterbium (Yb), and lutetium (Lu).

In example embodiments, in the Chemical Formula 1, a, b, c, and d may satisfy $80\leq a\leq 85$, $5\leq b\leq 3$, $4\leq C\leq 10$, and $0.5\leq d\leq 3$.

In example embodiments, the metallic glass may be one of $Al_{85}Ni_5Y_6Co_2Li_2$, $Al_{85}Ni_5Y_6Co_2Ca_2$, $Al_{83}Ni_{5.5}Y_{10}Si_{1.5}$, $Al_{84}Ni_5Y_6Co_2Ca_2N_1$, and $Al_{83}Ni_{5.5}Y_6Co_2La_2Si_{1.5}$.

In example embodiments, the metallic glass may form a surface crack during a Vickers indentation test.

In example embodiments, a particle size distribution of the metallic glass after pulverization may satisfy $D_{50}\leq 5$ μm.

In example embodiments, a particle size of the metallic glass after puliverization to form particles may be less than about 5 μm in greater than or equal to about 20% of the particles of the metallic glass after the pulverization.

In example embodiments, a conductive paste may include: a conductive powder, the foregoing metallic glass, and an organic vehicle.

In example embodiments, the metallic glass may be represented by the above-described Chemical Formula 1.

In example embodiments, the second element group may be at least one of lithium (Li), sodium (Na), potassium (K), rubidium (Rb), cesium (Cs), magnesium (Mg), calcium (Ca), strontium (Sr), barium (Ba), boron (B), carbon (C), silicon (Si), germanium (Ge), nitrogen (N), phosphorus (P), arsenic (As), and antimony (Sb).

In example embodiments, the transition metal may be at least one element of nickel (Ni), cobalt (Co), manganese (Mn), zirconium (Zr), titanium (Ti), vanadium (V), chromium (Cr), manganese (Mn), iron (Fe), copper (Cu), zinc (Zn), niobium (Nb), molybdenum (Mo), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), and gold (Au), and the rare earth element may be at least one element selected from scandium (Sc), yttrium (Y), lanthanum (La), cerium (Ce), praseodymium (Pr), neodymium (Nd), promethium (Pm), samarium (Sm), europium (Eu), gadolinium (Gd), dysprosium (Dy), holmium (Ho), erbium (Er), thulium (Tm), ytterbium (Yb), and lutetium (Lu).

In example embodiments, the metallic glass may be one of $Al_{85}Ni_5Y_6Co_2Li_2$, $Al_{85}Ni_5Y_6Co_2Ca_2$, $Al_{83}Ni_{5.5}Y_{10}Si_{1.5}$, $Al_{84}Ni_5Y_6Co_2Ca_2N_1$, and $Al_{83}Ni_{5.5}Y_6Co_2La_2Si_{1.5}$.

In example embodiments, at least part of the metallic glass may be a powder.

In example embodiments, an average particle size of the metallic glass may be less than or equal to about 5 μm.

In example embodiments, the conductive powder may include one of aluminum (Al), silver (Ag), copper (Cu), nickel (Ni), an alloy thereof, and a combination thereof.

In example embodiments, the conductive powder, the metallic glass, and the organic vehicle may be included in respective amounts of about 30 to about 99 wt %, about 0.1 to about 20 wt %, and a balance amount based on a total weight of the conductive paste.

In example embodiments, an electronic device may include an electrode including a sintered product of the conductive paste.

According to example embodiments, a metallic glass may be represented by the following Chemical Formula 1.

$$Al_aTM_bRE_cX_d \quad \text{[Chemical Formula 1]}$$

In the above Chemical Formula 1,

Al is aluminum,

TM is at least one kind of a transition metal,

RE is at least one kind of a rare earth element,

X is an element having an electronegativity difference from the aluminum of greater than or equal to about 0.25 and less than or equal to about 1.43, X is at least one of an alkaline metal, an alkaline earth metal, a semi-metal, and a non-metal, $0<d\leq 3$, at least one of b and c is not 0, $a+b+c+d=100$, none of a, b, c, and d are less than 0.

In example embodiments, a may satisfy $50<a\leq 99$, and X may be at least one of lithium (Li), sodium (Na), potassium (K), rubidium (Rb), cesium (Cs), magnesium (Mg), calcium (Ca), strontium (Sr), barium (Ba), boron (B), carbon (C), silicon (Si), germanium (Ge), nitrogen (N), phosphorus (P), arsenic (As), and antimony (Sb).

In example embodiments, at least part of the metallic glass may be a power, and an average particle size of the powder in the metallic glass may be less than or equal to about 5 μm.

In example embodiments, the metallic glass may be an alloy having a disordered structure, and an amorphous part of the metallic glass may be about 50 volume % to about 100 volume % of the metallic glass.

In example embodiments, a conductive paste may include: a conductive powder, the foregoing metallic glass, and an organic vehicle.

BRIEF DESCRIPTION OF THE DRAWINGS

The foregoing and other features and advantages of inventive concepts will be apparent from the more particular description of non-limiting embodiments of inventive concepts, as illustrated in the accompanying drawings in which like reference characters refer to the same parts throughout the different views. The drawings are not necessarily to scale, emphasis instead being placed upon illustrating principles of inventive concepts. In the drawings.

DETAILED DESCRIPTION

Figure 1:
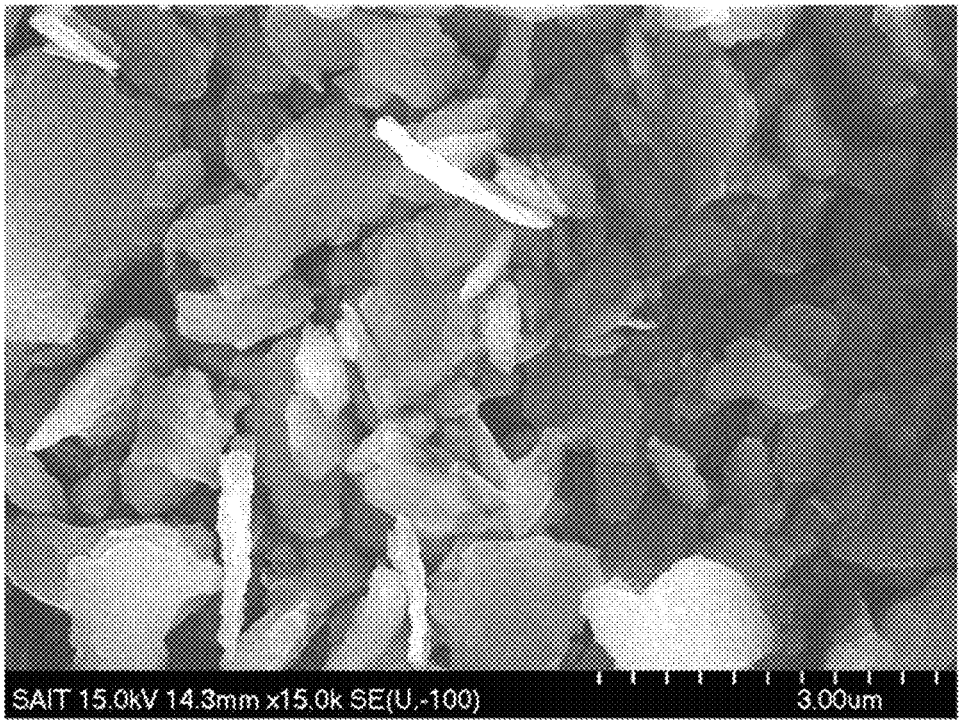
FIG. 1 is a SEM photograph showing pulverized powder of a metallic glass according to Preparation Example 1.

Example embodiments will now be described more fully with reference to the accompanying drawings, in which some example embodiments are shown. Example embodiments, may, however, be embodied in many different forms and should not be construed as being limited to the embodiments set forth herein; rather, these example embodiments are provided so that this disclosure will be thorough and complete, and will fully convey the scope of example embodiments of inventive concepts to those of ordinary skill in the art. In the drawings, the thicknesses of layers and regions are exaggerated for clarity. Like reference numerals in the drawings denote like elements, and thus their description may be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof. Expressions such as "at least one of," when preceding a list of elements, modify the entire list of elements and do not modify the individual elements of the list.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, metallic glasses according to example embodiments are described.

According to example embodiments, metallic glasses are an amorphous phased alloy having a disordered atomic structure including a plurality of elements. The metallic glass may also be referred to as an amorphous metal. The metallic glass includes an amorphous part that may be formed by rapidly quenching a plurality of elements. The amorphous part may be about 50 volume % to about 100 volume % of the metallic glass, for example about 70 volume % to about 100 volume %, and/or about 90 volume % to about 100 volume %.

In example embodiments, the amorphous part may be formed when the metallic glass is in a liquid phase at a high temperature, and the metallic glass may maintain the amorphous part at room temperature. Accordingly, in example embodiments, the metallic glass has a different structure from the crystalline structure of a general metal alloy having a regular arrangement of elements when being quenched into a solid phase, and is also different from the structure of liquid metals present in a liquid phase at room temperature.

A metallic glass according to example embodiments includes: aluminum (Al); a first element group consisting of at least one element selected from a transition metal and a rare earth element; and a second element group consisting of at least one element selected from an alkaline metal, an alkaline-earth metal, a semi-metal, and a non-metal. The second element group may have an electronegativity difference from the aluminum of greater than or equal to about 0.25.

The aluminum (Al) may be a main component of the metallic glass, wherein the main component may refer to an element having the greatest ratio of elements of the metallic glass. For example, the aluminum (Al) may be greater than or equal to about 50 at % of the metallic glass, based on all of the elements of the metallic glass.

Aluminum (Al) is a low resistance metal, and may increase conductivity of the metallic glass, and/or may enable a processing at a relatively low temperature because aluminum (Al) may be easily deformed at a low temperature.

The first element group may consist of (or include) at least one of a transition metal and a rare earth element, for example at least one kind of transition metal, at least one kind of rare earth element, and a combination thereof.

The transition metal may be at least one element selected from nickel (Ni), cobalt (Co), manganese (Mn), zirconium (Zr), titanium (Ti), vanadium (V), chromium (Cr), manganese (Mn), iron (Fe), copper (Cu), zinc (Zn), niobium (Nb), molybdenum (Mo), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), and gold (Au), and for example at least one element selected from nickel (Ni), cobalt (Co), manganese (Mn), and zirconium (Zr).

The rare earth element may be at least one element selected from scandium (Sc), yttrium (Y), lanthanum (La), cerium (Ce), praseodymium (Pr), neodymium (Nd), promethium (Pm), samarium (Sm), europium (Eu), gadolinium (Gd), dysprosium (Dy), holmium (Ho), erbium (Er), thulium (Tm), ytterbium (Yb), and lutetium (Lu), and for example yttrium (Y), lanthanum (La), cerium (Ce), neodymium (Nd), and gadolinium (Gd).

The first element group is an element group forming an alloy with the aluminum through a metallic bond, and may show amorphous characteristics and wettability of the metallic glass.

The second element group may consist of at least one element selected from an alkaline metal, an alkaline-earth metal, a semi-metal, and a non-metal having an electronegativity difference from the aluminum of greater than or equal to about 0.25.

The alkaline metal may be at least one element selected from, for example, lithium (Li), sodium (Na), potassium (K), rubidium (Rb), and cesium (Cs).

The alkaline-earth metal may be at least one element selected from, for example, magnesium (Mg), calcium (Ca), strontium (Sr), and barium (Ba).

The semi-metal and the non-metal may be at least one element selected from, for example, boron (B), carbon (C), silicon (Si), germanium (Ge), nitrogen (N), phosphorus (P), arsenic (As), and antimony (Sb).

The second element group may include, for example, an alkaline metal; an alkaline-earth metal; a semi-metal; a non-metal; a combination of an alkaline metal and an alkaline-earth metal; a combination of an alkaline metal and a semi-metal; a combination of an alkaline metal and a non-metal; a combination of an alkaline-earth metal and a semi-metal; a combination of an alkaline-earth metal and a non-metal; a combination of a semi-metal and a non-metal; a combination of an alkaline metal, an alkaline-earth metal, and a semi-metal; a combination of an alkaline metal, an alkaline-earth metal, and a non-metal; a combination of an alkaline metal, a semi-metal, and a non-metal; a combination of an alkaline-earth metal, a semi-metal, and a non-metal; a combination of an alkaline metal, an alkaline-earth metal, a semi-metal, and a non-metal; and the like.

The following Table 1 shows an electronegativity differences (ΔNE) of aluminum (electronegativity: 1.61) from examples of the aforementioned alkaline metal, alkaline-earth metal, semi-metal, and non-metal.

TABLE 1

| | ΔNE | | ΔNE | | ΔNE |
|---|---|---|---|---|---|
| Lithium (Li) | 0.63 | Magnesium (Mg) | 0.3 | Carbon (C) | 0.94 |
| Sodium (Na) | 0.68 | Calcium (Ca) | 0.61 | Silicon (Si) | 0.29 |
| Potassium (K) | 0.79 | Strontium (Sr) | 0.66 | Germanium (Ge) | 0.4 |
| Rubidium (Rb) | 0.82 | Barium (Ba) | 0.72 | Nitrogen (N) | 1.43 |
| Cesium (Cs) | 0.79 | Boron (B) | 0.43 | Phosphorus (P) | 0.58 |
| Arsenic (As) | 0.57 | Antimony (Sb) | 0.44 | | |

Since the second element group may be an element group capable of increasing brittleness of the metallic glass, the metallic glass may be pulverized into a fine powder.

In general, a metallic glass may be obtained, for example, using a gas atomization method, and the obtained metallic glass may have an average particle size of tens of micrometers and may include only about 5% of particles having a size of less than or equal to about 5 μm.

On the other hand, metallic glasses may have a characteristic of increased ductility when metallic glass particles have a smaller size. Accordingly, when the metallic glass having an average particle size of tens of micrometers is pulverized, the metallic glass may be crushed and form chunks having a larger size rather than being pulverized into fine powder. In addition, when the metallic glass is pulverized, the pulverization energy may be supplied and thus transforms a phase of the metallic glass and quickly crystallizes the metallic glass. Accordingly, the metallic glass may be difficult to pulverize into fine powder having an amorphous phase.

As described above, the second element group consists of elements having large electronegativity differences from that of aluminum (Al) as a main component for the metallic glass, wherein the large electronegativity difference indicates a large ion bond and/or covalent bond. Accordingly, compared with a metallic glass only comprising the first element group and aluminum (Al) having a metallic bond therewith, the metallic glass further including the second element group may further partially induce an ion bond and/or a covalent bond, which may change bondage and bondage tendency among the elements in the metallic glass and form a desired (and/or alternatively predetermined) void, and thus increase brittleness of the metallic glass. Accordingly, the metallic glass may be pulverized into amorphous-phased fine powder having a small particle size.

Herein, the second element group is included in amount of less than or equal to about 3 at % based on the total amount of the aluminum (Al), the first element group, and the second element group. When the second element group is included within the range, brittleness of the metal glass may not only be improved, but it may also have appropriate glass forming ability. The second element group may be included in an amount of about 0.5 to 3 at % within the range.

The metallic glass may be represented by, for example, the following Chemical Formula 1.

$$Al_aTM_bRE_cX_d \quad \text{[Chemical Formula 1]}$$

In the above Chemical Formula 1,

Al is aluminum,

TM is at least one kind of transition metal,

RE is at least one kind of rare earth element, and

X is the second element group.

As described above, the transition metal (TM) may be, for example, at least one element selected from nickel (Ni), cobalt (Co), manganese (Mn), zirconium (Zr), titanium (Ti), vanadium (V), chromium (Cr), manganese (Mn), iron (Fe), copper (Cu), zinc (Zn), niobium (Nb), molybdenum (Mo), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), and gold (Au), the rare earth element (RE) may be, for example, at least one element selected from scandium (Sc), yttrium (Y), lanthanum (La), cerium (Ce), praseodymium (Pr), neodymium (Nd), promethium (Pm), samarium (Sm), europium (Eu), gadolinium (Gd), dysprosium (Dy), holmium (Ho), erbium (Er), thulium (Tm), ytterbium (Yb), and lutetium (Lu), and the second element group X may be, for example, at least one element selected from lithium (Li), sodium (Na), potassium (K), rubidium (Rb), cesium (Cs), magnesium (Mg), calcium (Ca), strontium (Sr), barium (Ba), boron (B), carbon (C), silicon (Si), germanium (Ge), nitrogen (N), phosphorus (P), arsenic (As), and antimony (Sb).

In the Chemical Formula 1, a, b, c, and d refer to fractions of the aluminum (Al), transition metal (TM), rare earth element (RE), and second element group (X), and $50<a\leq 99$, $0\leq b\leq 30$, $0\leq c\leq 30$, and $0<d\leq 3$, wherein b and c are not simultaneously 0, and $a+b+c+d=100$.

Within the range, a, b, c, and d may satisfy, for example, $80\leq a\leq 85$, $5\leq b\leq 8$, $4\leq c\leq 10$, and $0.5\leq d\leq 3$.

The metallic glass may include, for example, $Al_{85}Ni_5Y_6Co_2Li_2$, $Al_{85}Ni_5Y_6Co_2Ca_2$, $Al_{83}Ni_{5.5}Y_{10}Si_{1.5}$, $Al_{84}Ni_5Y_6Co_2Ca_2N_1$, and $Al_{83}Ni_{5.5}Y_6Co_2La_2Si_{1.5}$, but is not limited thereto.

The metallic glass may have a surface crack in a Vickers indentation test as brittleness of the metallic glass increases as aforementioned. Herein, the surface crack is contrasted with a shear band occurring in a ductile metallic glass. The surface crack may be formed, for example, in one direction, both directions, and a radial and/or random direction.

The metallic glass may be pulverized into fine powder as brittleness of the metallic glass increases, as aforementioned. The pulverization may be preformed, for example, in an air jet milling method. The metallic glass may have a particle size after pulverization satisfying, for example, $D_{50}\leq 5$ μm. Herein, the $D_{50}$ denotes a particle size of 50% relative to a maximum value in a cumulative distribution, when the particle size is measured by using a particle size analyzer.

In addition, the metallic glass may have a particle size of less than about 5 μm in a ratio of greater than or equal to about 20% after the pulverization. As aforementioned, the metallic glass has a larger contact area and higher reactivity by increasing the ratio of fine powder having a comparatively high ratio, as aforementioned.

Accordingly, wettability of the metallic glass may be increased during heat treatment. Specifically, the ratio may be in a range of about 20 to 99%, and more specifically, in a range of about 20 to 80% within the range.

Hereinafter, a conductive paste including the metallic glass is described.

A conductive paste according to example embodiments includes a conductive powder, a metallic glass, and an organic vehicle.

The conductive powder may include a silver (Ag)-containing metal such as silver or a silver alloy, an aluminum (Al)-containing metal such as aluminum or an aluminum alloy, a copper (Cu)-containing metal such as copper (Cu) or a copper alloy, a nickel (Ni)-containing metal such as nickel (Ni) or a nickel alloy, or a combination thereof. However, the conductive powder is not limited thereto, and may include other metals and an additive other than the metals.

The conductive powder may have a size (e.g., average particle size) of about 1 nm to about 50 μm, and may include one or more kinds.

As described above, in example embodiments, a metallic glass includes aluminum (Al); a first element group consisting of at least one element selected from a transition metal and a rare earth element; and a second element group consisting of at least one element selected from an alkaline metal, an alkaline-earth metal, a semi-metal, and a non-metal and having an electronegativity difference from the aluminum of greater than or equal to about 0.25, wherein the second element group is included in amount of less than or equal to about 3 at % based on the total amount of the aluminum (Al), the first element group, and the second element group.

In example embodiments, the conductive paste may include one of the metallic glasses according to example embodiments described above.

At least a part of the metallic glass may be included with a pulverized powder shape, and the pulverized powder-shaped metallic glass may, for example, have an average particle size of less than or equal to about 5 μm. The metallic glass may have an average particle size about 3 μm to about 5 μm within the range.

The organic vehicle may include an organic compound that is mixed with the conductive powder and metallic glass and imparts appropriate viscosity to the organic vehicle, and a solvent dissolving the above components.

The organic compound may include, for example, at least one selected from a (meth)acrylate-based resin, a cellulose resin such as ethyl cellulose, a phenol resin, an alcohol resin, TEFLON (tetrafluoroethylene), and a combination thereof, and may further include an additive such as a dispersing agent, a surfactant, a thickener, and a stabilizer.

The solvent may be any solvent being capable of dissolving the above compounds, and may include, for example, at least one selected from terpineol, butylcarbitol, butylcarbitol acetate, pentanediol, dipentyne, limonene, ethylene glycol alkylether, diethylene glycol alkylether, ethylene glycol alkylether acetate diethylene glycol alkylether acetate, diethylene glycol dialkylether acetate, triethylene glycol alkylether acetate, triethylene glycol alkylether, propylene glycol alkylether, propylene glycol phenylether, dipropylene glycol alkylether, tripropylene glycol alkylether, propylene glycol alkylether acetate, dipropylene glycol alkylether acetate, tripropylene glycol alkyl ether acetate, dimethylphthalic acid, diethylphthalic acid, dibutylphthalic acid, and desalted water.

The conductive powder, the metallic glass, and the organic vehicle may be included in each amount of about 30 to about 99 wt %, about 0.1 to about 20 wt %, and a balance amount based on the total weight of the conductive paste.

The conductive paste may be applied, using screen printing, and the like for example, and may be used as an electrode of an electronic device. The electronic device may be, for example, a liquid crystal display (LCD), a plasma display device (PDP), an organic light emitting diode (OLED), a solar cell, and the like, but is not limited thereto.

The electrode may include a sintered product of the conductive paste.

The electrode may have contact resistance of less than or equal to about 1 $K\Omega cm^2$. Within the contact resistance range of the electrode, electric power loss caused by an electrode may be effectively reduced, and efficiency of an electronic device, specifically a solar cell, may be improved. Specifically, the electrode may have contact resistance of about 1 $\mu\Omega cm^2$ to about 20 $m\Omega cm^2$.

One of the electronic devices may be a solar cell.

Figure 6:
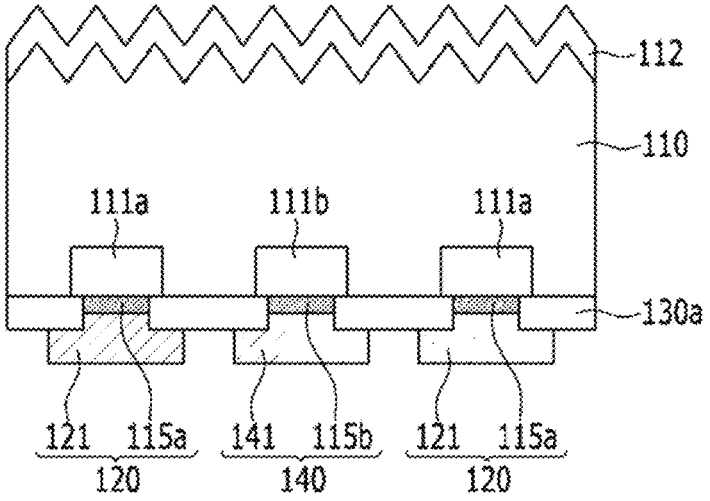
FIG. 6 is the cross-sectional view showing a solar cell according to example embodiments.

Referring to FIG. 6, a solar cell according to example embodiments is described.

FIG. 6 is a cross-sectional view showing a solar cell according to example embodiments.

Hereinafter, the spatial relationship of components will be described with respect to a semiconductor substrate 110 for better understanding and ease of description, but the present disclosure is not limited thereto. In addition, a solar energy incident side of a semiconductor substrate 110 is termed a front side, and the opposite side is called a rear side, although alternative configurations are possible.

Referring to FIG. 6, a solar cell according to example embodiments includes a semiconductor substrate 110 doped with p-type or n-type impurities.

The semiconductor substrate 110 may include silicon (e.g., crystalline silicon or multi-crystalline silicon) or a compound semiconductor. The crystalline silicon may be, for example, a silicon wafer. The p-type impurity may be a Group III element such as boron (B), and the n-type impurity may be a Group V element such as phosphorus (P). However, example embodiments are not limited thereto.

The semiconductor substrate 110 may be subjected to a surface-texturing treatment. The surface-textured semiconductor substrate 110 may, for example, have protrusions and depressions like a pyramid, or a pore structure like a honeycomb. The surface-textured semiconductor substrate 110 may have an enlarged surface area to enhance a light-absorption rate and decrease reflectivity, resultantly improving efficiency of a solar cell.

The semiconductor substrate 110 may include a first doping region 111*a* and a second doping region 111*b* on the rear side of the semiconductor substrate 110. For example, the first doping region 111*a* may be doped with an n-type impurity, and the second doping region 111*b* may be doped with a p-type impurity. The first doping region 111*a* and the second doping region 111*b* may be alternately disposed on the rear side of the semiconductor substrate 110.

An insulation layer 112 is formed on the semiconductor substrate 110. The insulation layer 112 may be formed of a material that absorbs less light and has an insulating property. For example, the insulation layer 112 may be formed of at least one of silicon nitride (SiNx), silicon oxide ($SiO_2$), titanium oxide ($TiO_2$), aluminum oxide ($Al_2O_3$), magnesium oxide (MgO), cerium oxide ($CeO_2$), and a combination thereof, and it may be formed of a single layer or multiple layers. The insulation layer 112 may have a thickness of about 200 to 1500 Å, but example embodiments are not limited thereto.

The insulation layer 112 may be an anti-reflective coating (ARC) that decreases reflectivity of light and increases selectivity of a particular wavelength region on the surface of the solar cell, and simultaneously improves contact properties with silicon at the surface of the semiconductor substrate 110, thereby increasing efficiency of the solar cell.

A passivation layer 130*a* including a plurality of contact holes may be disposed on the rear side of the semiconductor substrate 110. The passivation layer 130*a* may be made of silicon oxide, silicon nitride, aluminum oxide, and the like.

A first electrode 120 electrically connected to the first doping region 111*a* and a second electrode 140 electrically connected to the second doping region 111*b* are respectively formed on the rear side of the semiconductor substrate 110. The first electrode 120 may contact the first doping region 111*a* through contact holes of the passivation layer 130*a*, while the second electrode 140 may contact the second doping region 111*b* through contact holes of the passivation layer 130*a*. The front electrode 120 and the rear electrode 140 may be alternately disposed.

The first electrode 120 may include a first buffer part 115*a* in a region contacting the first doping region 111*a* and a first electrode part 121 in regions other than the first buffer part 115*a*. The second electrode 140 may include a second buffer part 115*b* in a region contacting the second doping region 111*b* and a second electrode part 141 in regions other than the second buffer part 115*b*.

The first electrode 120 and the second electrode 140 may be formed of one of the above-described conductive pastes according to example embodiments. However, the first and second electrodes 120 and 140 are not limited thereto, and either of the first electrode 120 and the second electrode 140 may be formed of the aforementioned conductive paste.

The first buffer part 115*a* and the second buffer part 115*b* may be formed of a metallic glass softened with the conductive paste and thus may have conductivity. The first buffer part 115*a* may respectively contact the first doping region 111*a* and the first electrode part 121, and thus enlarge the area of a path through which charges move from the first doping region 111*a* to the first electrode part 121 and limit (and/or prevent) loss of the charges. Likewise, the second buffer part 115*b* may respectively contact the second doping region 111*b* and the second electrode part 141, and thus enlarge the area of a path through which charges move from the second doping region 111*b* to the second electrode part 141 and limit (and/or prevent) loss of the charges.

Hereinafter, the method of manufacturing a solar cell is described with reference to FIGS. 7 to 10.

FIGS. 7 to 10 are cross-sectional views sequentially showing a method of manufacturing a solar cell according to example embodiments.

Figure 7:
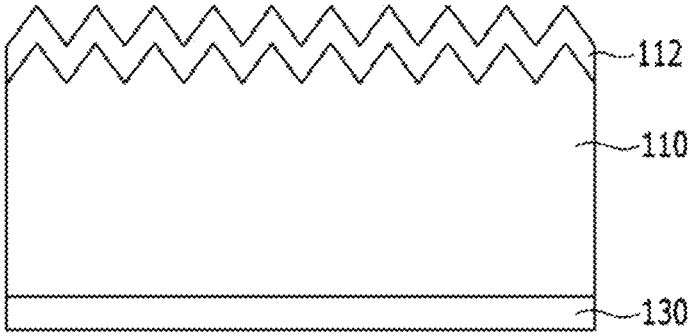
FIGS. 7 to 10 are cross-sectional views showing a method of manufacturing the solar cell according to example embodiments.

First, referring to FIG. 7, a semiconductor substrate 110 doped with, for example, an n-type impurity is prepared. Then, the semiconductor substrate 110 is surface-textured, and the insulation layer 112 and passivation layer 130 are disposed on the front and rear sides of the semiconductor substrate 110, respectively. The insulation layer 112 and the passivation layer 130 may be provided by chemical vapor deposition (CVD), for example.

Figure 8:
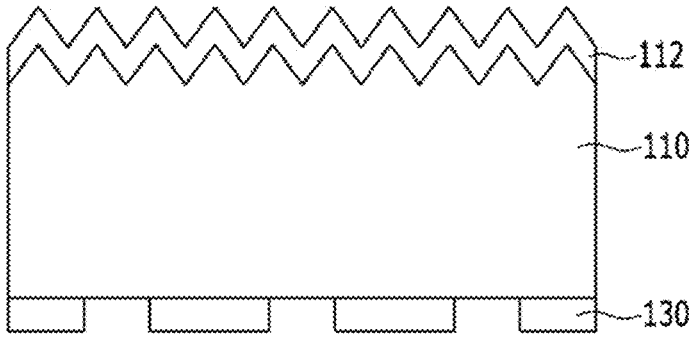

Referring to FIG. 8, the passivation layer 130 is patterned to provide a passivation layer 130*a* to expose a part of the rear side of the semiconductor substrate 110.

Figure 9:
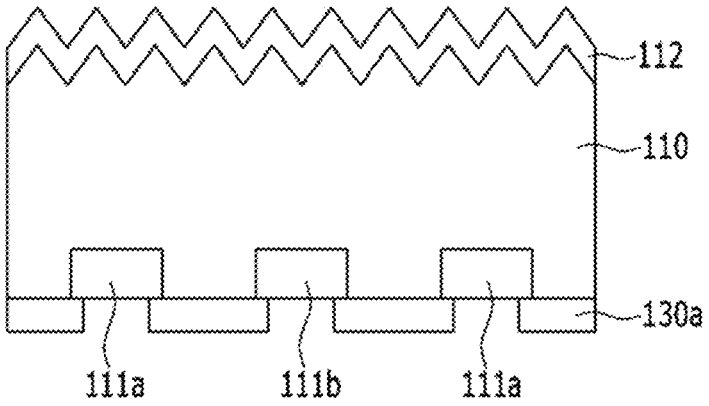

Referring to FIG. 9, the first doping region 111*a* and the second doping region 111*b* may be disposed by sequentially doping a p-type impurity and an n-type impurity at a high concentration on the rear side of the semiconductor substrate 110. The first doping region 111*a* and the second doping region 111*b* may be doped with impurities with a higher concentration, for example, than the semiconductor substrate 110. Optionally, the first doping region 111*a* and the second doping region 111*b* may be formed before formation of the passivation layer 130.

Figure 10:
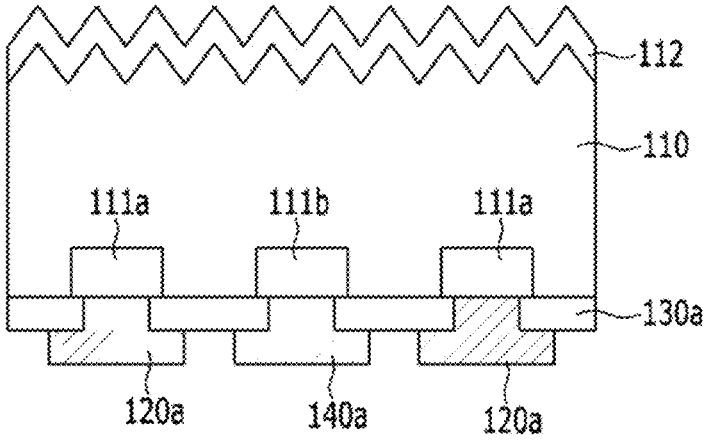

Referring to FIG. 10, a conductive paste 120*a* for the first electrode is applied on a portion corresponding to the first doping region 111*a*, and a conductive paste 140*a* for the second electrode is applied on a portion corresponding to the second doping region 111*b* on one side of the passivation layer 130*a*. The conductive paste 120*a* for the first electrode and the conductive paste 140*a* for the second electrode may be the above-described conductive paste. The conductive paste 120*a* for the first electrode and the conductive paste 140*a* for the second electrode may be formed using screen printing.

The conductive paste 120*a* for the first electrode and the conductive paste 140*a* for the second electrode may be fired together or separately.

Herein, the sintering process is performed at a higher temperature than the glass transition temperature (Tg) of the metallic glass in the conductive paste 120*a* for the first electrode and the conductive paste 140*a*, and thereby the metallic glass of the conductive paste undergoes plastic deformation and shows wettability.

Even though FIG. 6 describes a soalr cell where the conductive paste is applied to form a back contact solar cell, the conductive paste may be applied to other solar cells. For example, FIG. 11 is a cross-sectional view showing a solar cell according to example embodiments.

Figure 11:
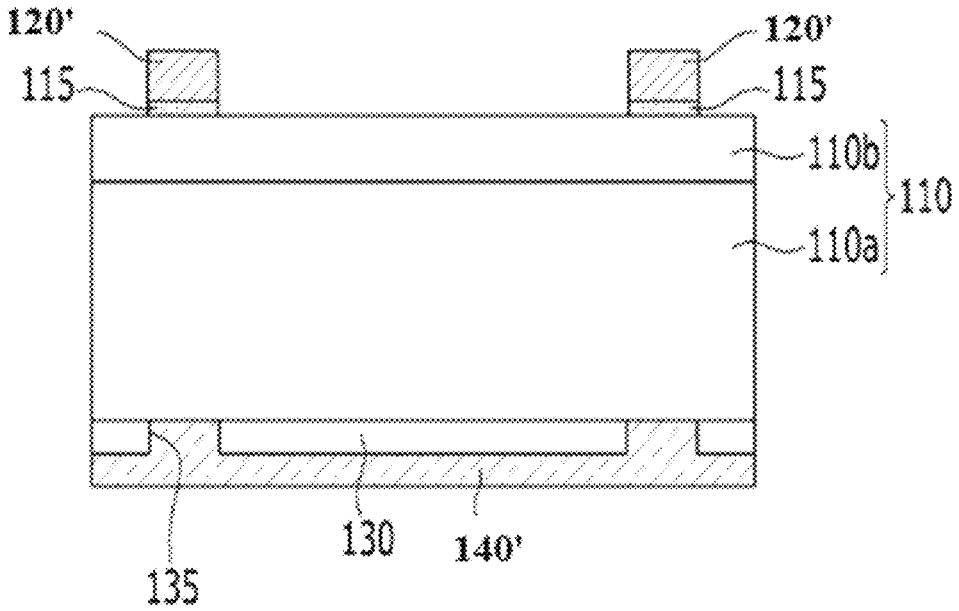
FIG. 11 is a cross-sectional view showing a solar cell according to example embodiments.

Referring to FIG. 11, a solar cell according to example embodiments may include a lower semiconductor layer 110*a* and an upper semiconductor layer 110*b* in the semiconductor substrate 110. Either of the lower semiconductor layer 110*a* and the upper semiconductor layer 110*b* may be a semiconductor layer doped with a p-type impurity, while the other may be a semiconductor layer doped with an n-type impurity. For example, the lower semiconductor layer 110*a* may be a semiconductor layer doped with a p-type impurity, and the upper semiconductor layer 110*b* may be a semiconductor layer doped with an n-type impurity. For example, if the semiconductor substrate 110 is a silicon wafer, the p-type impurity may be a Group III element such as boron (B), and the n-type impurity may be a Group V element such as phosphorus (P).

The surface of the upper semiconductor layer 110*b* may be textured. An anti-reflection coating (not shown) may be disposed on the upper semiconductor layer 110*b*.

The front electrode 120' may be formed by screen printing one of the above-described conductive pastes according to example embodiments on the upper semiconductor layer 110*b*. A buffer layer 115 is disposed between the upper semiconductor layer 110*b* and the front electrode 120' by heat treating the conductive paste disposed to form the front electrode 120'. The buffer layer 115 may be conductive due to inclusion of a metallic glass. Because the buffer layer 115 has portions that contact the electrode 120 and the upper semiconductor layer 110*b*, it may decrease loss of electric charges by improving a path for transferring the electric charges between the upper semiconductor layer 110*b* and the front electrode 120.

A dielectric layer 130 may be disposed under the semiconductor substrate 110. The dielectric layer 130 may include a through-hole 135. Through the through-hole 135, a rear electrode 140' may contact the semiconductor substrate 110.

The dielectric layer 130 may comprise silicon oxide ($SiO_2$), silicon nitride ($SiN_x$), aluminum oxide ($Al_2O_3$), or a combination thereof, and may have a thickness of about 100 to about 2000 angstroms and/or about 200 to about 1800 angstroms. The dielectric layer 130 may be omitted.

A rear electrode 140' is disposed under the dielectric layer 130. The rear electrode 140' may comprise a conductive material, for example, an opaque metal such as aluminum (Al). The rear electrode 140' may be formed by a screen printing method using one of the above-described conductive pastes according to example embodiments in the same manner as the front electrode 120'.

A buffer layer (not shown) may be disposed between the rear electrode 140' and the lower semiconductor layer 110*a* in the same manner as the front electrode 120'.

In addition, even though a conductive paste according to example embodiments maybe applied to form an electrode for a solar cell, example embodiments are not limited thereto, and a conductive paste according to example embodiments may be applied to form an electrode for other electronic devices.

The following examples illustrate this disclosure in further detail. However, it is understood that this disclosure shall not be limited by these examples.

Preparation of Metallic Glass

Preparation Example 1

7.052 g of aluminum (Al), 0.902 g of nickel (Ni), 1.64 g of yttrium (Y), 0.362 g of cobalt (Co), and 0.043 g of lithium (Li) are prepared and melted by using an arc melter or an induction melter, preparing an Al—Ni—Y—Co—Li mother alloy. The Al—Ni—Y—Co—Li mother alloy is injected into a quartz tube, and the quartz tube is mounted in a melt spinner. The melt spinner is maintained in a vacuum state, and a chamber is supplied with argon (Ar) gas to form an argon atmosphere. Subsequently, the metal is melted by using an induction heating apparatus, and the molten metal is discharged from an outlet of the quartz tube by making argon (Ar) gas flow into the quartz tube. The molten metal is quickly cooled down on a copper (Cu) wheel, manufacturing a ribbon-shaped metallic glass, $Al_{85}Ni_5Y_6Co_2Li_2$.

Otherwise, the Al—Ni—Y—Co—Li mother alloy is inserted in a crucible, and the crucible is mounted in an atomizer. The atomizer is maintained in a vacuum state, and a chamber is supplied with argon (Ar) gas to form an argon atmosphere. Subsequently, the metal is melted by using an inductive heating apparatus, and an inert gas at a high pressure is dispersed at a high speed into the molten solution, manufacturing a powdered metal glass, $Al_{85}Ni_5Y_6Co_2Li_2$.

Preparation Example 2

A metallic glass, $Al_{85}Ni_5Y_6Co_2Ca_2$, is prepared according to the same method as Preparation Example 1, except for using 6.911 g of aluminum (Al), 0.884 g of nickel (Ni), 1.608 g of yttrium (Y), 0.355 g of cobalt (Co), and 0.242 g of calcium (Ca) instead of the aluminum (Al), nickel (Ni), yttrium (Y), cobalt (Co), and lithium (Li).

Preparation Example 3

A metallic glass, $Al_{83}Ni_{5.5}Y_{10}Si_{1.5}$, is prepared according to the same method as Preparation Example 1, except for using 6.410 g of aluminum (Al), 0.924 g of nickel (Ni), 2.545 g of yttrium (Y), and 0.121 g of silicon (Si) instead of the aluminum (Al), nickel (Ni), yttrium (Y), cobalt (Co), and lithium (Li).

Preparation Example 4

A metallic glass, $Al_{84}Ni_5Y_6Co_2Ca_2N_1$, is prepared according to the same method as Preparation Example 1, except for using 6.857 g of aluminum (Al), 0.888 g of nickel (Ni), 1.614 g of yttrium (Y), 0.357 g of cobalt (Co), 0.243 g of calcium (Ca), and 0.042 g of nitrogen (N) (the nitrogen is supplied as an AlN alloy) instead of the aluminum (Al), nickel (Ni), yttrium (Y), cobalt (Co), and lithium (Li).

Preparation Example 5

A metallic glass, $Al_{83}Ni_{5.5}Y_6Co_2La_2Si_{1.5}$, is prepared according to the same method as Preparation Example 1, except for using 6.338 g of aluminum (Al), 0.914 g of nickel (Ni), 1.510 g of yttrium (Y), 0.334 g of cobalt (Co), 0.786 g of lanthanum (La) and 0.119 g of silicon (Si) instead of the aluminum (Al), nickel (Ni), yttrium (Y), cobalt (Co), and lithium (Li).

Comparative Preparation Example 1

A metallic glass, $Al_{85}Ni_5Y_8Co_2$, is prepared without lithium (Li) according to the same method as Preparation Example 1.

Comparative Preparation Example 2

A metallic glass, $Al_{85}Ni_5Y_6Co_2Be_2$, is prepared according to the same method as Preparation Example 1, except for using beryllium (Be) (with an electronegativity difference from aluminum (Al) (ΔNE): 0.04) instead of lithium (Li).

Comparative Preparation Example 3

A metallic glass, $Al_{85}Ni_5Y_4Co_2Ca_4$, is prepared according to the same method as Preparation Example 2, except for using calcium (Ca) in an excess amount.

Comparative Preparation Example 4

A metallic glass, $Al_{83.5}Ni_{5.5}Y_7Si_4$, is prepared according to the same method as Preparation Example 3, except for using silicon (Si) in an excess amount.

Evaluation

Evaluation 1

The metallic glasses according to Preparation Example 1 and Comparative Preparation Example 1 are pulverized in an air jet milling method, and brittleness of the pulverized powder is evaluated.

Air jet pulverization is a method of proceeding pulverization by collision of spherical powders, through which the metallic glass having improved brittleness is pulverized and has a sharply decreased average particle size distribution, while a common metallic glass is not minutely pulverized but crushed rather than broken and forms chunks.

The brittleness degree of the pulverized powder is evaluated by transformation degree of the powder shape before and after pulverization.

Figure 2:
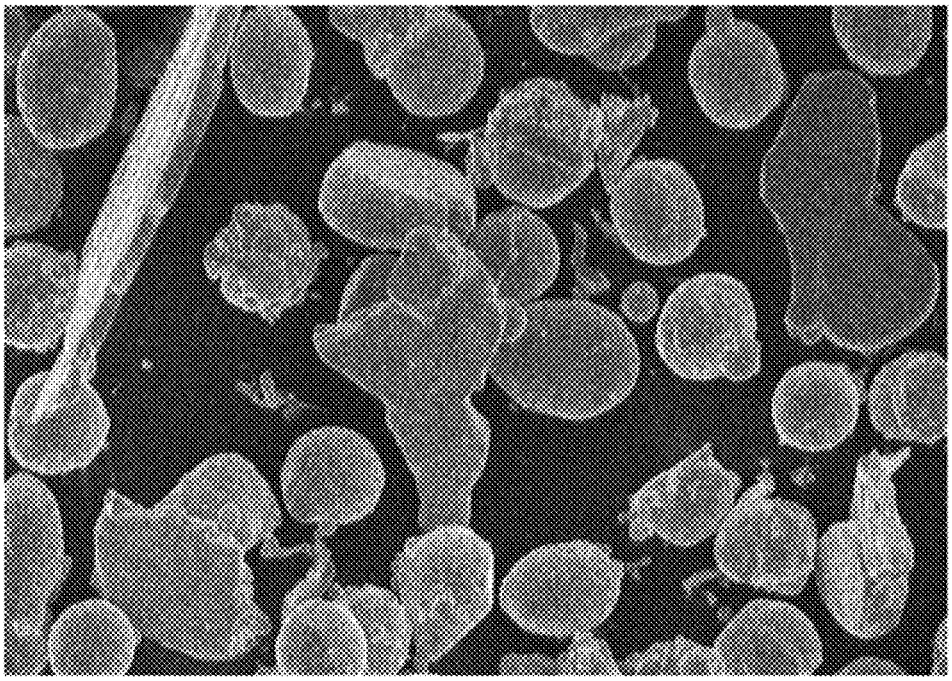
FIG. 2 is a SEM photograph showing pulverized powder of a metallic glass according to Comparative Preparation Example 1.

FIG. 1 is a SEM photograph showing pulverized powder of the metallic glass according to Preparation Example 1, while FIG. 2 is a SEM photograph showing pulverized powder of the metallic glass according to Comparative Preparation Example 1.

Referring to FIGS. 1 and 2, pulverized powder of the metallic glass according to Preparation Example 1 is broken into fine particles, while pulverized powder of the metallic glass according to Comparative Preparation Example 1 is not broken but crushed and forms chunks.

Accordingly, the metallic glass according to Preparation Example 1 is a brittle metallic glass, and the metallic glass according to Comparative Preparation Example 1 is ductile metallic glass.

Evaluation 2

An indentation test is conducted in a Vickers indentation method to evaluate if the metallic glasses according to Preparation Examples 1 to 5 and Comparative Preparation Examples 1 to 4 have cracks at their surface. The Vickers indentation method is a method for measuring a mechanical property of a sample by compressing and deforming with a diamond tip with a load of about 25 to 150 gf. The condition of the Vickers indentation method of the metallic glass in the present evaluation is as the below: a load of 150 gf, a holding time of 10 seconds, Vickers indents of 86 μm diameter.

When metallic glass has cracks at its surface, the metallic glass is a brittle metallic glass, while when metallic glass has a shear band, the metallic glass is a ductile metallic glass. The cracks or the shear band at metallic glass's surface is confirmed by scanning electron microscope.

The results are provided in Table 2.

TABLE 2

| | Crack generation | Shear band generation |
|---|---|---|
| Preparation Example 1 | ○ | x |
| Preparation Example 2 | ○ | x |
| Preparation Example 3 | ○ | x |
| Preparation Example 4 | ○ | x |
| Preparation Example 5 | ○ | x |
| Comparative Preparation Example 1 | x | ○ |
| Comparative Preparation Example 2 | x | ○ |
| Comparative Preparation Example 3 | x | ○ |
| Comparative Preparation Example 4 | x | ○ |

Referring to Table 2, the metallic glasses according to Preparation Examples 1 to 5 have cracks on their surface after an indentation test according to a Vickers indentation method, while the metallic glasses according to Comparative Preparation Examples 1 to 4 have a shear band after an indentation test according to a Vickers indentation method. Accordingly, the metallic glasses according to Preparation Examples 1 to 5 are brittle metallic glasses, while the metallic glasses according to Comparative Preparation Examples 1 to 4 are ductile metallic glasses.

Evaluation 3

After the metallic glasses according to Preparation Example 5 and Comparative Preparation Example 1 are pulverized in an air jet milling method, particle size distribution of the pulverized powder is evaluated. In the air jet milling method, a rate of providing metallic glasses is about 0.67 g/min and an air spraying pressure is about 1.15 MPa.

The particle size distribution is evaluated by using a particle size analyzer in a wet method.

Figure 3:
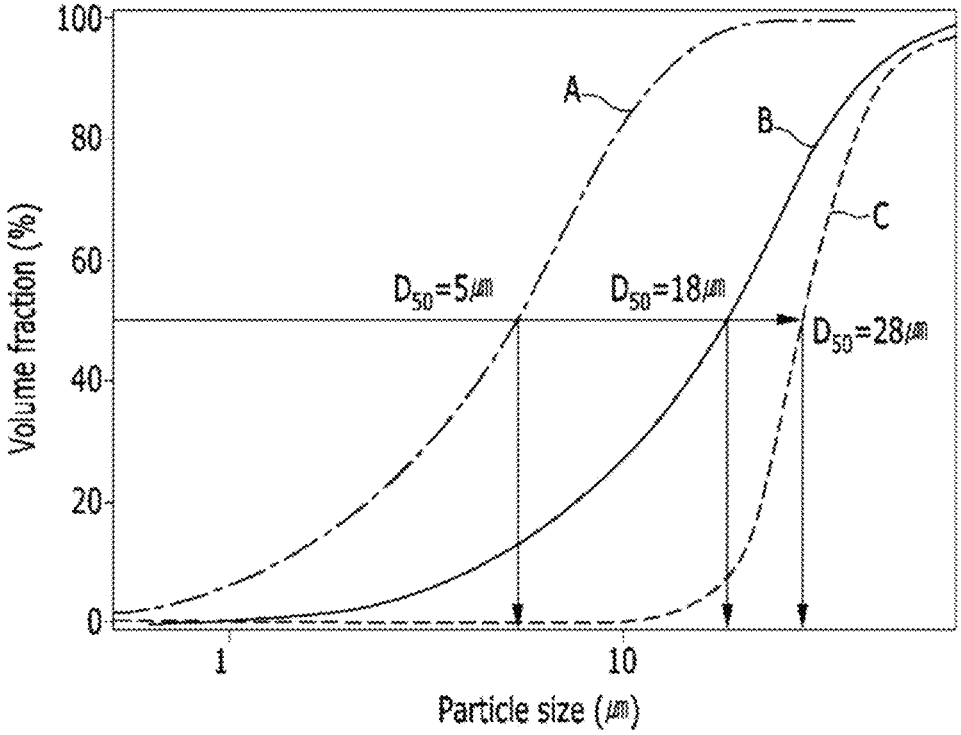
FIG. 3 is a graph showing particle size distributions of a metallic glass according to Preparation Example 5, pulverized powder of the metallic glass according to Preparation Example 5, and pulverized powder of the metallic glass according to Comparative Preparation Example 1.

The results are provided in FIG. 3.

FIG. 3 is a graph showing particle size distribution of the metallic glass according to Preparation Example 5 and pulverized powders of the metallic glasses according to Preparation Example 5 and Comparative Preparation Example 1.

Referring to FIG. 3, pulverized powder A of the metallic glass according to Preparation Example 5 is more distributed in a smaller particle diameter area than the powder C of the metallic glass before the pulverization and pulverized powder B of the metallic glass according to Comparative Preparation Example 1. In addition, the pulverized powder A of the metallic glass according to Preparation Example 5 has $D_{50}$ of about 5 μm, while the pulverized powder B of the metallic glass according to Comparative Preparation Example 1 has $D_{50}$ of about 18 μm, but the powder C before the pulverization has $D_{50}$ of about 28 μm.

In addition, the pulverized powder A of the metallic glass according to Preparation Example 5 has about a ratio of particles having a size of less than or equal to 5 μm of 50%, which is remarkably increased compared with those of the powder (C) before the pulverization and the pulverized powder (B) of the metallic glass according to Comparative Preparation Example 1 (respectively, ratios of about 3.7% and about 10%).

Evaluation 4

The metallic glasses according to Preparation Examples 1 to 5 and Comparative Preparation Examples 1 to 4 are pulverized in an air jet milling method, and then evaluated regarding whether the pulverized powders have an amorphous phase.

The amorphous phase is evaluated in an X-ray diffraction analysis method (XRD), for example, when a broad peak is found in an XRD graph, the pulverized powder has an amorphous phase, while when at least one sharp peak is found in the XRD graph, the pulverized powder has a crystalline phase.

The results are provided in Table 3.

TABLE 3

| | Phase |
|---|---|
| Preparation Example 1 | amorphous phase |
| Preparation Example 2 | amorphous phase |
| Preparation Example 3 | amorphous phase |
| Preparation Example 4 | amorphous phase |
| Preparation Example 5 | amorphous phase |
| Comparative Preparation Example 1 | amorphous phase |
| Comparative Preparation Example 2 | amorphous phase |
| Comparative Preparation Example 3 | crystalline phase |
| Comparative Preparation Example 4 | crystalline phase |

Referring to Table 3, the metallic glasses according to Preparation Examples 1 to 5 maintained the amorphous phase, while the metallic glass including calcium (Ca) in an excess amount according to Comparative Preparation Example 3 and the metallic glass including silicon (Si) in an excess amount according to Comparative Preparation Example 4 are pulverized and have the crystalline phase.

Evaluation 5

The metallic glasses according to Preparation Example 5 and Comparative Preparation Example 1 are pulverized in an air jet milling method, and then the heat flow characteristic of the powders before and after the pulverization is evaluated.

Figure 4:
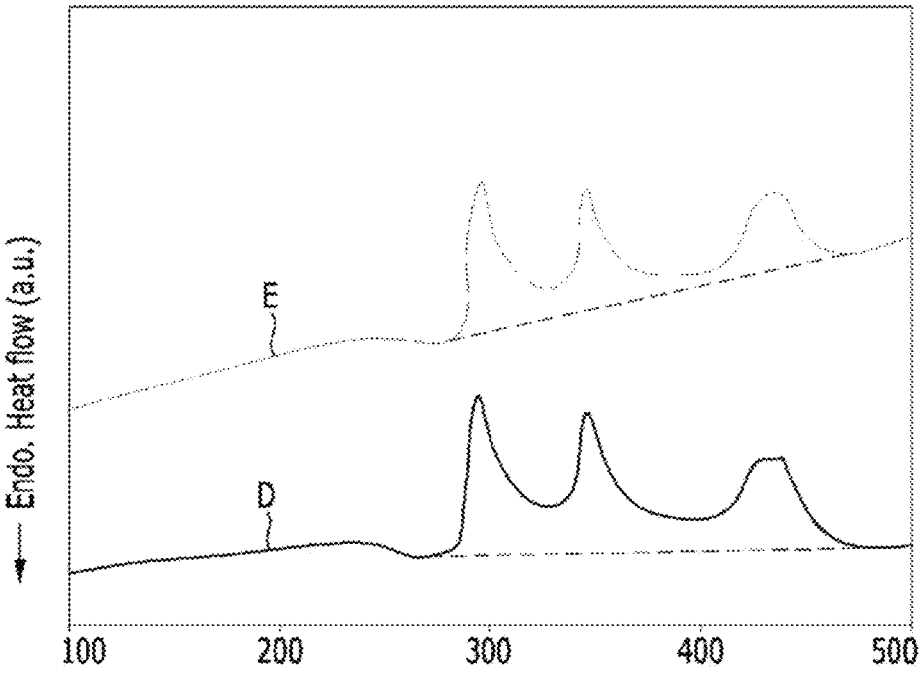
FIG. 4 is a graph showing a heat flow characteristic of the metallic glass according to Preparation Example 5 before and after the pulverization depending on temperature.
Figure 5:
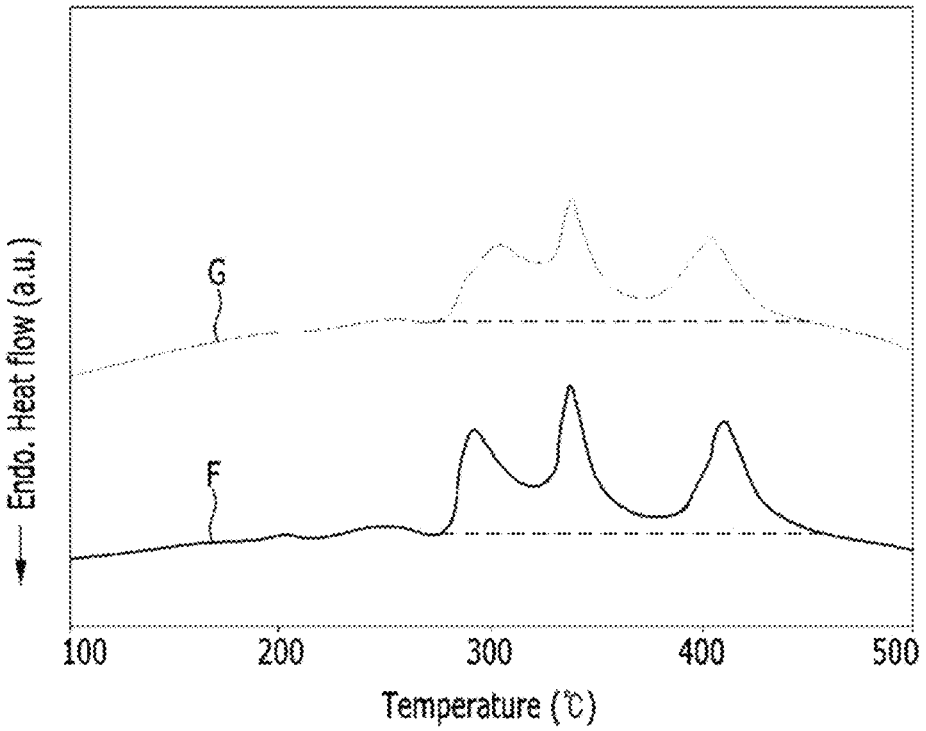
FIG. 5 is a graph showing a heat flow characteristic of the metallic glass according to Comparative Preparation Example 1 before and after the pulverization depending on temperature.

FIG. 4 is a graph showing the heat flow characteristic of powder of the metallic glass according to Preparation Example 5 before and after the pulverization depending on temperature, and FIG. 5 is a graph showing the heat flow characteristic of powder of the metallic glass according to Comparative Preparation Example 1 before and after the pulverization depending on temperature.

Referring to FIGS. 4 and 5, the metallic glass according to Preparation Example 5 has almost no heat flow characteristic change before the pulverization D and after the pulverization E depending on temperature, while the metallic glass according to Comparative Preparation Example 1 has a large heat flow characteristic change before the pulverization F and after the pulverization G depending on temperature.

Accordingly, the metallic glass according to Preparation Example 5 maintains the heat flow characteristic after the pulverization, while the metallic glass according to Comparative Preparation Example 1 has a transformed characteristic after the pulverization.

Evaluation 6

The metallic glass according to Preparation Example 5 is pulverized in an air jet milling method, and then electrical characteristics of the powder before and after the pulverization is evaluated.

The electric characteristics are evaluated by using a conductive paste including the metallic glass to form an electrode sample and measuring specific resistance and contact resistance of the electrode sample.

The electrode sample 1 is formed in the following method.

The metallic glass according to Preparation Example 5 and silver (Ag) powder are added to an organic vehicle including an ethyl cellulose binder, a surfactant, and a mixed solvent of butylcarbitol/butylcarbitol acetate. Herein, the metallic glass according to Preparation Example 5, the silver (Ag) powder, and the organic vehicle are respectively mixed in an amount of 82.58 wt %, 3.93 wt %, and 13.49 wt % based on the total weight of a conductive paste. Subsequently, the components are mixed with a 3-roll mill, preparing a conductive paste. The conductive paste is coated on a silicon wafer in a screen printing method. The coated silicon water is heated up to about 600° C. in a belt furnace. The heated resultant is cooled down, forming an electrode sample 1.

An electrode sample 2 is formed according to the same method as the electrode sample 1 except for using a conductive paste prepared by using pulverized powder of the metallic glass according to Preparation Example 5 instead of the metallic glass according to Preparation Example 5.

Specific resistance of the electrode samples 1 and 2 is calculated by measuring line resistance with a 2-point probe and then an electrode cross-section with a laser confocal microscope, and contact resistance of the electrode samples 1 and 2 is measured in a transmission line method (TLM).

The results are provided in Table 4.

TABLE 4

| | Specific resistance (μ Ω cm) | Contact resistance (m Ω $cm^2$) |
|---|---|---|
| Electrode sample 1 | 3.4 | 0.41 |
| Electrode sample 2 | 3.4 | 0.47 |

Referring to Table 4, the electrode samples 1 and 2 have similar specific resistance and contact resistance. Accordingly, the pulverized powder of the metallic glass according to Preparation Example 5 maintains the electrical characteristics.

While some example embodiments have been particularly shown and described, it will be understood by one of ordinary skill in the art that variations in form and detail may be made therein without departing from the spirit and scope of the claims.

What is claimed is:

1. A metallic glass, comprising:

aluminum (Al);

a first element group including a transition metal and a rare earth element, the transition metal being at least one of nickel and cobalt, and the rare earth element being yttrium; and a second element group including at least one of an alkaline metal, an alkaline-earth metal, a semi-metal, and a non-metal, the second element group having an electronegativity difference from the aluminum of greater than or equal to about 0.25, the second element group is included in an amount of less than or equal to about 3 at % based on a total amount of the aluminum (Al), the first element group, and the second element group, wherein the metallic glass is represented by the following Chemical Formula 1, $$Al_aTM_bRE_cX_d \quad \text{[Chemical Formula 1]}$$

wherein, in the above Chemical Formula 1,

Al is aluminum,

TM is at least one of nickel and cobalt,

RE is yttrium,

X is the second element group, $50<a\leq 99$, $0\leq b\leq 30$, $0\leq c\leq 30$, $0<d\leq 3$, and $a+b+c+d=100$, wherein the second element group includes at least one of lithium (Li), sodium (Na), potassium (K), rubidium (Rb), cesium (Cs), magnesium (Mg), calcium (Ca), strontium (Sr), barium (Ba), carbon (C), germanium (Ge), nitrogen (N), phosphorus (P), arsenic (As), and antimony (Sb).

2. The metallic glass of claim 1, wherein $80\leq a\leq 85$, $5\leq b\leq 8$, and $4\leq c\leq 10$.

3. A metallic glass, comprising:

aluminum (Al);

a first element group including at least one of a transition metal and a rare earth element; and a second element group including at least one of an alkaline metal, an alkaline-earth metal, a semi-metal, and a non-metal, the second element group having an electronegativity difference from the aluminum of greater than or equal to about 0.25, the second element group is included in an amount of less than or equal to about 3 at % based on a total amount of the aluminum (Al), the first element group, and the second element group, wherein the metallic glass is one of $Al_{85}Ni_5Y_6Co_2Li_2$, $Al_{85}Ni_5Y_5Co_2Ca_2$, $Al_{83}Ni_{5.5}Y_{10}Si_{1.5}$, $Al_{84}Ni_5Y_6Co_2Ca_2N_1$, and $Al_{83}Ni_{5.5}Y_6Co_2La_2Si_{1.5}$.

4. The metallic glass of claim 1, wherein the metallic glass has a brittle property such that the metallic glass forms a surface crack during a Vickers indentation test.

5. The metallic glass of claim 1 wherein the metallic glass is in the form of particles, and a particle size distribution of the metallic glass is $D_{50}\leq 5$ μm.

6. The metallic glass of claim 1, wherein the metallic glass is in the form of particles, and a particle size of the metallic glass is less than about 5 μm in at least about 20% of the particles of the metallic glass.

7. The metallic glass of claim 1, wherein an electronegativity difference between the second element group and the aluminum is about 0.29 to about 1.43.

8. A conductive paste, comprising a conductive powder, the metallic glass of claim 1, and an organic vehicle.

9. A conductive paste comprising a conductive powder, the metallic glass of claim 3, and an organic vehicle.

10. The conductive paste of claim 8, wherein at least part of the metallic glass is a powder.

11. The conductive paste of claim 10, wherein an average particle size of the powder in the metallic glass is less than or equal to about 5 μm.

12. The conductive paste of claim 8, wherein the conductive powder includes one of aluminum (Al), silver (Ag), copper (Cu), nickel (Ni), an alloy thereof, and a combination thereof.

13. The conductive paste of claim 8, wherein the conductive powder, the metallic glass, and the organic vehicle are included in respective amounts of about 30 to about 99 wt %, about 0.1 to about 20 wt %, and a balance amount based on a total weight of the conductive paste.

* * * * *